US006089038A

United States Patent [19]

Tattam

[11] Patent Number: 6,089,038

[45] Date of Patent: Jul. 18, 2000

[54] TRANSPORT CONTAINER

[76] Inventor: Edwin Francis Tattam, Magpies, Grubbins Lane, Speen, Bucks. HP27 0SH, United Kingdom

[21] Appl. No.: 09/217,619

[22] Filed: Dec. 22, 1998

[30] Foreign Application Priority Data

Dec. 23, 1997 [GB] United Kingdom ..... 9727031
Jul. 3, 1998 [GB] United Kingdom ..... 9814342

[51] Int. Cl.[7] ..... F25D 3/08

[52] U.S. Cl. ..... 62/457.2; 62/60; 62/371

[58] Field of Search ..... 62/371, 60, 457.2

[56] References Cited

U.S. PATENT DOCUMENTS

| | | | |
|---|---|---|---|
| 4,343,158 | 8/1982 | Campbell | 62/372 |
| 4,377,075 | 3/1983 | Russo | 62/372 |
| 4,630,448 | 12/1986 | Bilstad et al. | 62/60 |
| 4,723,974 | 2/1988 | Ammerman | 62/4 |
| 4,881,646 | 11/1989 | Weber | 206/460 |
| 5,005,374 | 4/1991 | Spitler | 62/259.3 |
| 5,313,809 | 5/1994 | Isaacson et al. | 62/530 |
| 5,361,603 | 11/1994 | Merritt-Munson | 62/457.2 |
| 5,533,361 | 7/1996 | Halpern | 62/457.2 |
| 5,701,757 | 12/1997 | Heverly | 62/457.2 |
| 6,020,013 | 2/2000 | Kozma | 426/393 |

FOREIGN PATENT DOCUMENTS

| | | | |
|---|---|---|---|
| 58-112976 | 7/1983 | Japan | B65D 81/38 |
| 2 004 839 | 4/1979 | United Kingdom | B65D 31/02 |
| 2 262 155 | 6/1993 | United Kingdom | F25D 3/08 |
| 97/28064 | 8/1997 | WIPO | B65D 81/18 |

*Primary Examiner*—Henry Bennett
*Assistant Examiner*—Mark Shulman
*Attorney, Agent, or Firm*—Bacon & Thomas

[57] ABSTRACT

A transport container comprising a plurality of layers (4) of flexible insulating material, an envelope (2) containing said layers (4) and shrunk against said layers (4), and a latent cavity (14) within the layers of flexible insulating material and openable to receive a product (16) to be transported in the transport container.

16 Claims, 9 Drawing Sheets

TRANSPORT CONTAINER

TECHNICAL FIELD

This invention relates to a transport container for use in transporting temperature sensitive products and keeping them either cool or protecting them from chilling in transit, as required.

BACKGROUND ART

Certain products need to be kept cool whilst being transported from place to place by postal or courier services, particularly from a manufacturer or distributor to a consumer for the product concerned. Examples of such products are food products, pharmaceuticals and bio-chemicals including diagnostics, and they are generally known as "cold chain" products. Other products need to be protected from chilling during transport, particularly from freezing in air cargo, and in this specification these products are referred to as "warm" products. Examples of "warm" products include certain other foodstuffs and pharmaceuticals, and blood products.

"Cold chain" and "warm" products have until now generally been transported in thermally insulated rigid containers such as polystyrene foam boxes or vacuum flasks as examples, but such containers are as bulky before use as during use giving storage problems, and can be fragile and expensive.

It is an object of the present invention to provide an improved transport container.

DISCLOSURE OF INVENTION

In accordance with the present invention, a transport container comprises a plurality of layers of flexible insulating material, an envelope containing said layers and shrunk against said layers, and a latent cavity within the layers of flexible insulating material and openable to receive a product to be transported in the transport container.

Preferably the envelope is heat shrunk against said layers.

Preferably also the envelope is made of polyethylene, especially linear low-density polyethylene.

Preferably also at least one of the layers of flexible insulating material also has energy absorbing properties to protect the product against damage in transit.

Preferably further at least the majority of the layers of flexible insulating material are foamed polyethylene.

Preferably further the envelope is heat-bonded in position.

Preferably further the plurality of layers of flexible insulating material are assembled together in a bag which is contained in the envelope.

Preferably further the envelope is contained within an outer shipping bag.

Preferably further the envelope is heat-bonded to the bag thus sealing the side walls of the container.

Preferably further the transport container is for use in transporting a cold chain product and the latent cavity contains a refrigerant and the cold chain product.

Preferably further the refrigerant is a quantity of dry ice.

Alternatively the refrigerant is a flexible layer containing a freezable liquid in its frozen state, in which case the flexible layer containing a freezable liquid may be separated from the product by a flexible thermal insulating layer.

The transport container may be for use in transporting a warm product in which case the latent cavity may contain a flexible layer containing a warmable liquid and the warm product. The warm product may be separated from the product by a flexible thermal insulating layer.

Preferably further said plurality of layers comprises a single sheet of flexible insulating material wound several times around itself to define the latent cavity within the layers of flexible insulating material, and one edge of the wound sheet being flattened with all of the layers bonded together at that edge to provide a closed base for the latent cavity.

Preferably further the other edge of the wound sheet is only partially flattened as a result of said one edge having been flattened, and all of the layers are bonded together at said other edge with the latent cavity openable to receive a product to be transported in the transport container.

Preferably further said other edge of the wound sheet is provided with closure means to close the latent cavity after the product has been received therein.

Alternatively said plurality of layers comprises an inner set of layers each consisting of a sheet of flexible insulating material folded into a U-shape and nested into the other folded sheets, and an outer set of layers resulting from a single sheet of flexible insulating material wound several times around the outside of the inner set of layers and closing the otherwise open sides of the inner set of layers.

Preferably at least the outermost layer of the outer set of layers is bonded together along and in the vicinity of the base of the U-shape of the outermost of the inner set of layers.

Preferably further all of the outer set of layers are bonded together along and in the vicinity of the base of the U-shape of the outermost of the inner set of layers.

Preferably further bonding is achieved by adhesive, or by the use of double-sided adhesive tape or by heat sealing using a jet of hot air.

Preferably further the transport container further comprises a shell comprising a plurality of layers of flexible insulating material, said shell being receivable within the latent cavity and including a shell latent cavity within its plurality of layers of flexible insulating material and openable to receive a product to be transported in the transport container and/or a refrigerant if the product is a cold chain product.

Preferably further the shell is to be wholly contained within the latent cavity.

Preferably further the shell has a closed base which is able to aid closure of the latent cavity.

The present invention also consists in a method of assembling a transport container comprising taking a shrinkable envelope, inserting in the envelope a plurality of layers of flexible insulating material, providing a latent cavity within the layers of flexible insulating material and openable to receive a product to be transported in the transport container, and shrinking the envelope.

Preferably the method includes opening the latent cavity by inserting the product into it.

Preferably also a method of assembling a transport container for use in transporting a cold chain product includes opening the latent cavity by inserting into it both a refrigerant and the cold chain product.

Preferably also the method includes subsequently shrinking the envelope by heat-shrinking.

Preferably further the envelope is heat-bonded in position.

Preferably also the method includes assembling said layers together in a bag which is then inserted in the envelope.

Preferably also the envelope is heat-bonded to the bag thus sealing the side walls of the container.

Preferably also the method includes sealing the envelope and then placing it in an outer shipping bag.

Other preferred features of the invention will be apparent from the following description and from the subsidiary claims of the specification.

BRIEF DESCRIPTION OF DRAWINGS

The invention will now be further described, merely by way of example, by reference to the accompanying drawings, in which.

BEST MODE OF CARRYING OUT THE INVENTION

Figure 1:
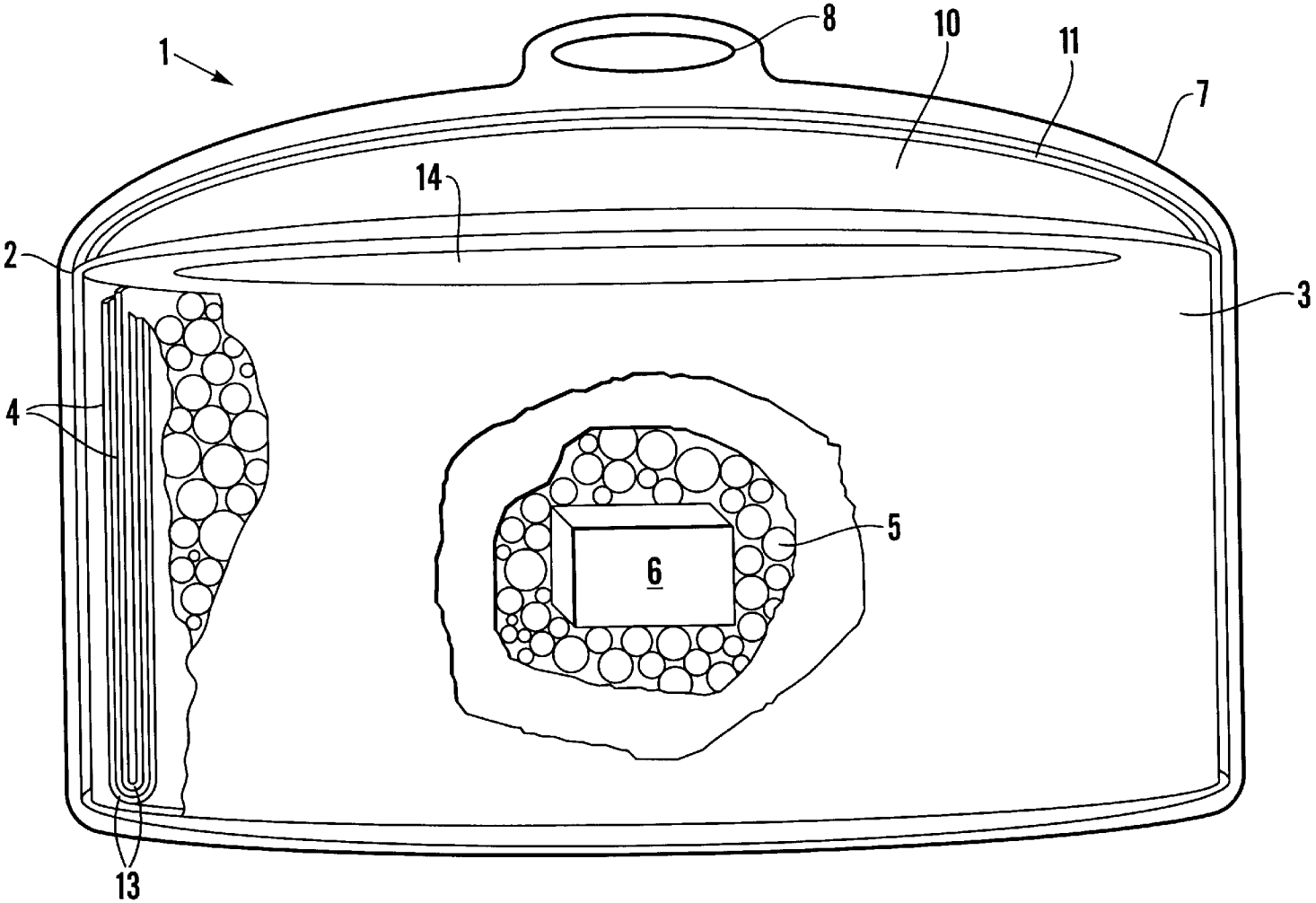
FIG. 1 is a perspective view, partly cut-away, of a transport container according to a first preferred example of the invention for use in transporting a cold chain product.
Figure 2:
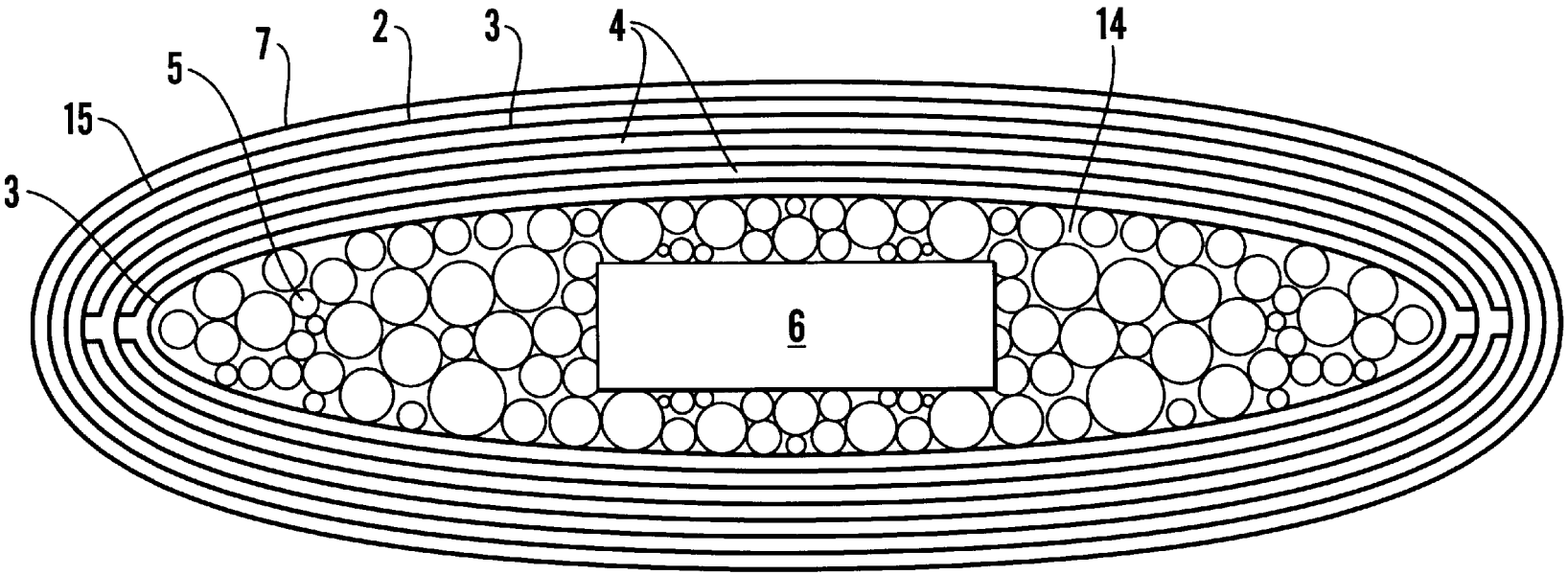
FIG. 2 is a cross-section of the transport container shown in FIG. 1.

FIGS. 1 and 2 of the drawings show the transport container 1 comprising an open envelope 2, a bag 3 lining the envelope 2, two layers 4 of flexible insulating material within the bag 3 and around the inside of the envelope 2, and a refrigerant 5 inside the inner of the layers 4. A product 6 which is to be transported in the transport container 1 and kept cool in transit by the refrigerant 5 is shown in FIG. 2 only. For clarity, the drawings show each of the contents mentioned above of the envelope 2 spaced apart from each other, and various voids in the envelope 2, but as explained below, all of those contents are actually tightly packed together, and when the envelope 2 has been sealed, there should be little void space in it. The envelope 2 is contained in an outer shipping bag 7, which carries the destination address and any shipping documents, and includes a carrying handle 8. The outer shipping bag 7, the envelope 2 and its contents will now be described in greater detail.

The envelope 2 has a generous closure flap 10 at its open end, but otherwise is closed all round, and is made of a strong heat-shrinkable linear low-density polyethylene. The flap 10 has a continuous adhesive strip 11 around it to obtain a good seal with the main body of the envelope 2 when the flap 10 is closed.

The bag 3 is made of heat-shrinkable linear low-density polyethylene and is about twice as long as it needs to be to line the envelope. Once the layers 4 are inside the bag, as described below, its open end protruding from the envelope is tucked back inside the innermost layer 4.

Each layer 4 of flexible insulating material is made of foamed polyethylene, which additionally furnishes energy absorbing properties to protect the product 6 against damage in transit, and is approximately the same width and twice the length as the envelope 2. Folding each layer 4 mid-way between its short sides into a "U"-shape enables the base 13 of the "U" to be pushed into the bag 3 inside the envelope 2 and down to its closed end, positioning the layer all around the inside of the envelope and open to the open end of the envelope 2. As shown in the drawings, two layers 4 are nested together in this way, but in practice as many layers 4 are used as are required to achieve the necessary insulation, typically eight, and possibly as many as sixteen. Each layer 3 is about 4 mm thick, so that eight layers provide a thickness of about 32 mm around the inside of the envelope 2 giving high thermal insulation and good energy absorption to physically protect the product 6 in transit. The innermost layers will automatically stand higher than the outermost layers, or can be longer to achieve this result, so that as the flap is pulled up, over the top of, and down the top edges of all of the layers 4 to be closed, those top edges are pressed tightly together to provide excellent insulation.

If required, several of the layers 4 can be of approximately twice the width and the same length as the envelope 2. Folding each of these layers into a "U"-shape enables an open edge of the "U" to be pushed into the bag inside the envelope and down to its closed end, the other open edge of the "U" being open to the open end of the envelope 2. The base 13 of the "U" then lies along the interior of the side of the envelope 2, making a greater contribution to the insulation along this side than two edges of a layer 4 would do.

The size of each layer 4 in relation to the size of the envelope 2, and the nesting of eight such layers together means that the layers have to be pushed with substantial force into the envelope 2, followed by tucking the open end of the bag 3 into the innermost of the layers 4. Most voids in the envelope are thereby eliminated. However, in the centre of the tucked-in bag 3 in the innermost layer there exists a latent cavity 14 which can be opened by having the refrigerant 5 and the product 6 thrust into it from the open end of the envelope, bowing out the otherwise largely flat faces of the envelope 2.

If required, the layers 4 can be assembled into the bag 3 before the bag is inserted into the envelope 2.

The refrigerant 5 in the first preferred example of the invention of FIGS. 1 and 2 is slices or pellets of frozen carbon dioxide, usually referred to as "dry ice", of which the desired quantity is packed into the latent cavity 14 with the product 6. The layers 4 are then quickly pressed together at the open end of the envelope 2 and the flap is folded across it and secured by the adhesive strip 11. The product 6 is, of course, pre-chilled to the dry ice sublimation temperature of −70 degrees C. The innermost layers 4 are almost instantly chilled by the dry ice to the same temperature, but the thickness and thermal insulation properties of all of the eight layers 4 mean that the outside of the envelope 2 is approximately at room temperature and therefore does not normally feel cold or become damp or slippery from atmospheric condensation. If required, the outer surface 15 of the envelope can be laminated to a layer of moisture absorbent non-woven fabric which will absorb any dampness and feel dry to the touch.

The filled and closed envelope 2 is then passed through an appropriate oven to heat shrink the envelope and heat-bond it to the bag 3 thus sealing the sidewalls of the container. This virtually eliminates all voids and cavities in the envelope, increasing its resilience to keep its contents tightly packed together, and minimises the surface area of the envelope - the surface area is a major factor in thermal gain and hence the smaller the surface area, the longer the product will stay below a desired maximum temperature in transit.

Alternatively, the envelope 2 containing the layers 4 can be heat-shrunk before the product 6 and refrigerant 5 are packed into it and, of course, before the envelope is sealed. The closure flap 10 is adequately protected from being heat-shrunk by being temporarily pushed into the tucked in bag 3. The refrigerant 5 and product are subsequently packed into and open the latent cavity against the high resilience of the heat-shrunk envelope 2, and the envelope is then quickly sealed.

When the envelope has been supplied with all of its contents, heat-shrunk and sealed, it is placed in the outer shipping bag 7 made of polyethylene carrying the destination address and any other information or shipping documents. If required, the outer shipping bag 7 can be a triple-layer laminate of which the layer to be adjacent the envelope 2 is an absorbent layer of non-woven polyethylene fabric, the next layer is a breathable polyethylene, and the outer layer is a semi-absorbent nonwoven polyethylene fabric.

Sublimation of the dry ice keeps the product 6 cold, the resulting gaseous carbon dioxide percolating out of the envelope 2 through the various layers of polyethylene. The resilience of the heat shrunk envelope stops voids from developing as the amount of dry ice reduces, shrinking the envelope 2 and still further minimising its surface area and therefore its rate of heat gain.

Increasingly large spaces exist between the shrinking envelope 2 and the outer shipping bag 7 which fill with gaseous carbon dioxide, providing additional insulation for the product 6 and also allowing that carbon dioxide more time to come to room temperature before percolating through the shipping bag 7. Hence the outside of the shipping bag 7 is at a temperature close to ambient, minimising atmospheric condensation on it, particularly if the triple-layer laminate is used.

If required, the layers 4 can be assembled together in a flat stack in the bag 3, which is correctly dimensioned to accept them in this stack. The bag 3 and the layers 4 inside it are then folded in half as they are put in the envelope 2 with the inner faces of the bag 3 inside the innermost layer 4 again defining the latent cavity 14. Subsequent heat shrinking and heat bonding of the envelope 2 seals the sides of the bag 3 together inside the envelope 2.

It will be appreciated that every constituent part of this first preferred embodiment is made of polyethylene, meaning that, after use, the transport container can readily be recycled. This is in contrast to a transport container of mixed materials, particularly if they include polystyrene or urea formaldehyde. Furthermore, the pressure exerted by the heat-shrunk envelope 2 on the layers 4 of polyethylene foam, possibly in conjunction with gaseous carbon dioxide percolating through those layers, reduces the thickness of the innermost of the layers 4 by up to 25%, particularly when little dry ice is left in the container. This reduces the bulk of the used transport container, again aiding recycling.

Figure 3:
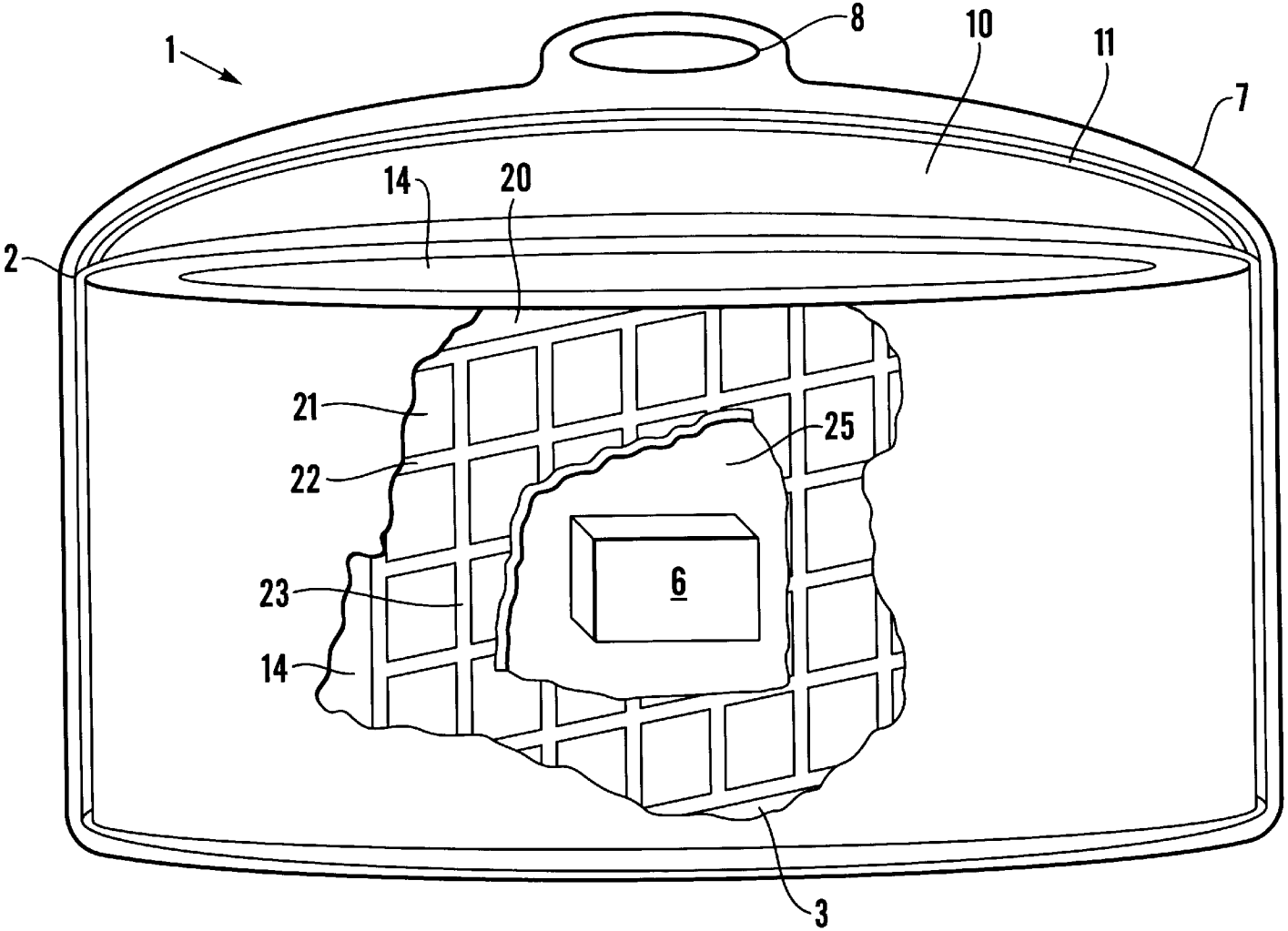
FIG. 3 is a perspective view, partly cut-away, of a transport container according to a second preferred example of the invention for use in transporting a cold chain or a warm product.

Referring now to FIG. 3 of the drawings, in the second preferred embodiment the transport container is used to ship products to be kept at about zero degrees centigrade. Consequently, the construction and use of the transport container is the same as described above, but instead of using dry ice at a temperature of about minus seventy degrees centigrade, an ice mat 20 is put in the latent cavity 14 with the product 6. The ice mat 20 is a multi-layered sheet of flexible plastics material formed with a plurality of individual pockets 21 filled with a freezable liquid such as water. The pockets 21 are formed in known manner by applying heat welding bars (not shown) to the sheet in a grid pattern to heat seal the sheet and form horizontal seams 22 and vertical seams 23.

It will be appreciated therefore that the pockets 21 can be formed in any configuration dependent on the way in which the welding bars are applied to it. For instance, they could be diamond shaped, square or rectangular.

The walls of each pocket 21 of the freezable ice mat 20 are preferably double skinned to give them added protection against being accidentally perforated. For this reason, the flexible freezable ice mat 20 would normally comprise four layers of material seam welded together to provide the pocket 21.

Although it is preferred to fill the pockets 21 with water, which will actually freeze and change into solid ice, they can be filled with a liquid such as ethylene glycol which does not actually freeze into a solid when subjected to temperatures between 0 and −10 degrees C., but instead changes to a semi-frozen slush.

It will be appreciated from the foregoing that the ice mat 20 will remain flexible after freezing because the seams 22,23 between adjacent pockets remain flexible when frozen so the pockets 21 can adapt themselves quite readily to the contours of a product 6 located inside the ice mat 20.

The ice mat 20 is preferably made from a multi-layered sheet of polyethylene, which maintains ease of recycling.

If the cold chain product 6 should not be allowed to freeze, but be kept in the temperature range of 2 to 8 degrees centigrade during transit, the ice mat 20 and the product 6 in the latent cavity 14 may be separated from each other by a layer 25 of foamed polyethylene to maintain the required temperature differential.

The second preferred embodiment described above can also be used for transporting warm products with the ice mat 20 warmed, if required, to an appropriate temperature, which may be about 22 degrees centigrade, before being inserted with the product 6 in the latent cavity 14. The thermal capacity of the product 6 and the ice mat 20, in conjunction with the high thermal insulation of the layers 4 and the compression achieved by heat-shrinking the envelope will prevent the product 6 from freezing during courier transit. The insulating layer 25 may also be useful in allowing the ice mat 20 to be slightly warmer.

If the thermal capacity of the product is sufficiently high, it may be possible to omit the use of the ice mat 20, inserting the product 6 alone in the latent cavity 14.

Figure 4:
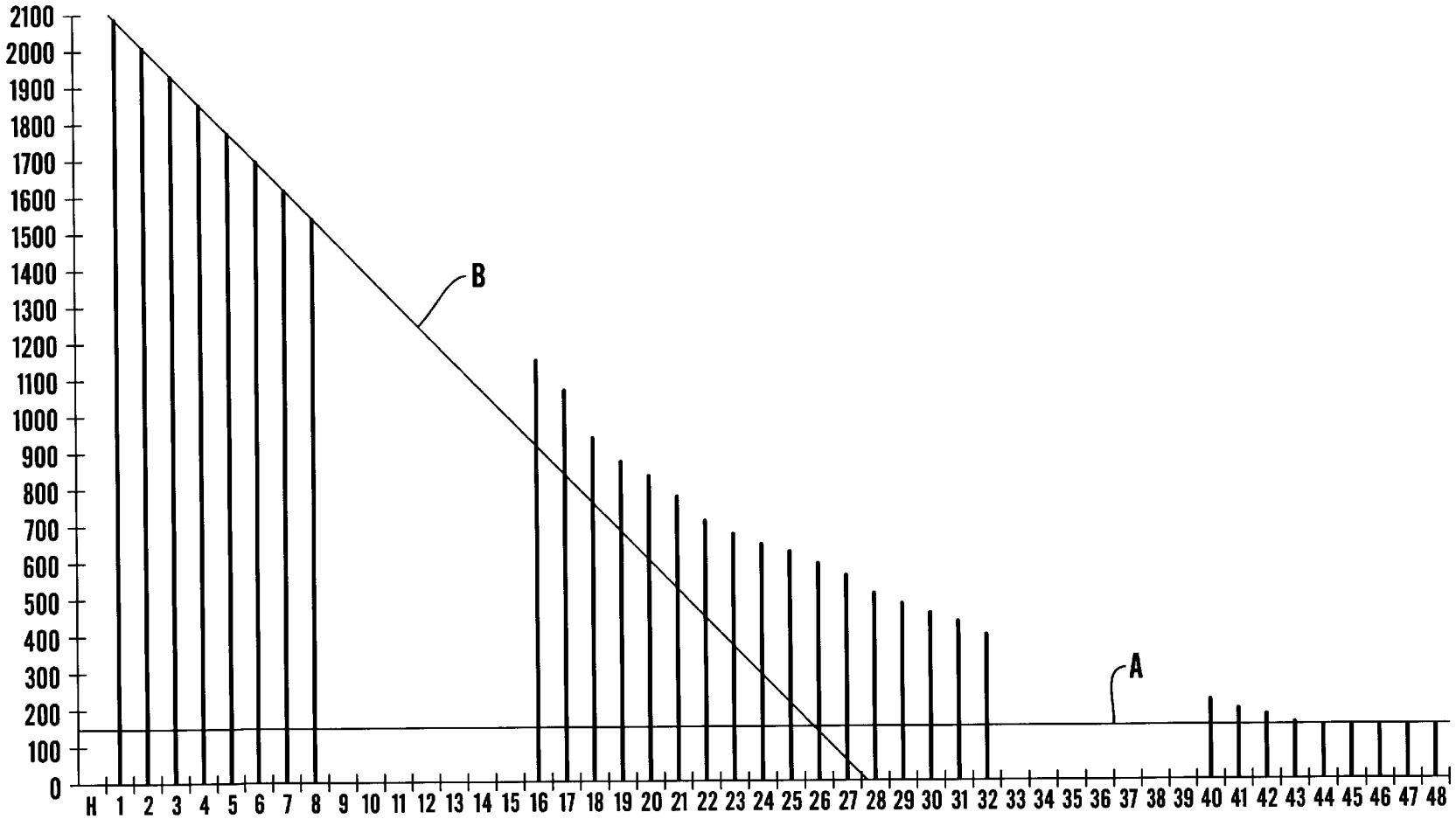
FIG. 4 is a test graph.

Referring now to the graph of FIG. 4 of the accompanying drawings, a test was made of the effectiveness of shrinking the envelope 2 on the longevity of acceptable transport time. A transport container according to the first preferred embodiment of FIGS. 1 and 2 was packed with the product and slices of dry ice, sealed, heat-shrunk and stored at ambient temperature of about 20 degrees centigrade. The graph shows the weight in grams of the packed container for each of the working hours in the test laboratory.

The weight of the container and the product together is about 140 grams, as can be seen at the end of the test after about 44 hours when all of the dry ice refrigerant has sublimed and percolated away. A line A across the graph marks this weight of 140 grams.

About two kilograms of dry ice were put in the container before it was sealed. The first weighing was made after one hour when the container had stabilised, which is shown on the graph at H1, which is 2080 grams.

The first eight weighings show a constant weight loss of about 66 grams per hour as dry ice is lost at this rate to keep the product at the dry ice sublimation temperature. This rate of loss is shown by line B. However, the increasing loss of volume of dry ice then allows the envelope to shrink further, reducing its surface area and therefore reducing the rate of heat gain by the container. The result is a reduction in the rate of loss of dry ice, measurable in the reducing weight losses hour by hour as clearly seen on the graph. Line B crosses line A when no dry ice would be left in a container of constant surface area after 26 hours, but in the test the dry ice continues to be present until 44 hours, showing a much more effective performance.

Figure 5:
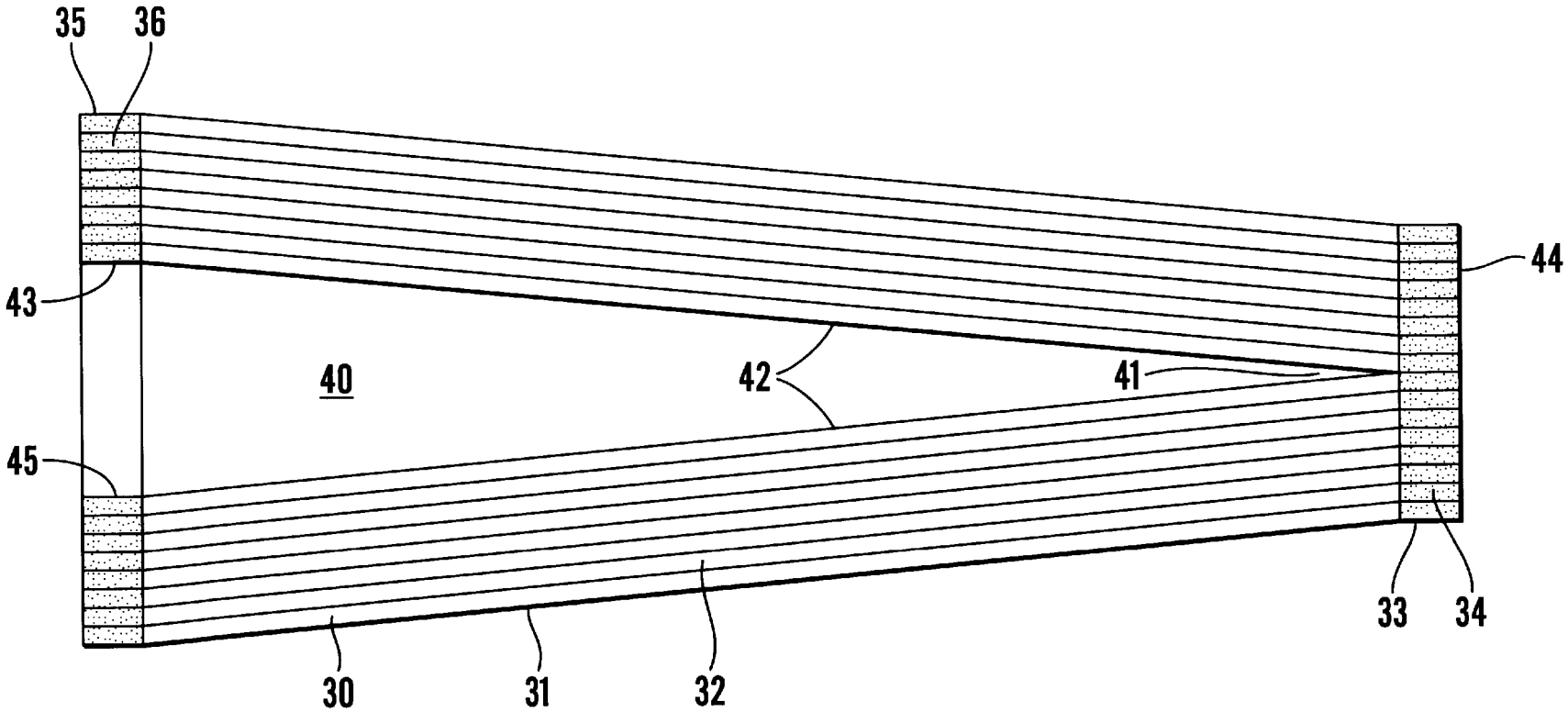
FIG. 5 is a partially broken away cross-sectional view of another typical example of a plurality of layers of flexible insulating material for use in a transport container.

Referring now to FIG. 5, a single sheet 30 of flexible insulating material of foamed polyethylene of constant width is wound around itself several times to form a wound sheet in the form of a multi-layered roll 31 of, in this example, eight layers 32. One edge 33 of the sheet 30 is then flattened and all of the sixteen layers 32 that are brought together are bonded together in a bonded zone 34. The other edge 35 of the sheet 30 is only partially flattened as a result of the one edge 33 having been flattened, so that the roll 31 is still largely open. The eight layers 32 are bonded together around the open side 35 in a bonded zone 36.

The layers 32 define a latent cavity 40 which has a straight closed base 41 on the inside of the bonded zone 34, and diverging sidewalls 42 constituted by the innermost of the layers 32. The cavity 40 has an open end 43 at the other edge 35 of the sheet 30.

Bonding may be achieved by adhesive, or by double-sided adhesive tape, or by heat sealing using a jet of air above 120 degrees Celsius to render the polyethylene sticky so that it can be bonded by being pressed together. Thus both edges of the single sheet 30 can be provided with the adhesive or tape, and as it is wound around itself to form the wound sheet in the form of a multi-layered roll, bonding is achieved in the bonded zones 34 and 36. The flattening of the one edge 33 then bonds together the innermost of the layers 32 to form the straight closed base 41 of the latent cavity 40.

The multi-layered roll 31 is assembled with the open envelope 2, the bag 3 lining the envelope 2 and the outer shipping bag 7 described above in the first typical example to form the transport container, and the envelope is heat shrunk. The flattened one edge 33 of the sheet also provides a flat end 44 of substantial width helping the transport container to be stood on end to receive the product to be transported and any refrigerant, such as dry ice, that is required into its open end 43. The open end 43 is then closed by being flattened parallel to the flattening of the one end 33. The open end 43 is provided with closure means 45 in the form of self-adhesive tape around the inside of the open end 43. The flexible sheet 30 is able to be distorted to accommodate the bulk of the product and refrigerant. If dry ice is used, its gradual loss permits the shrunk envelope to keep the layers 32 tightly together, and minimises the surface area and therefore the rate of heat gain of the transport container.

Figure 6:
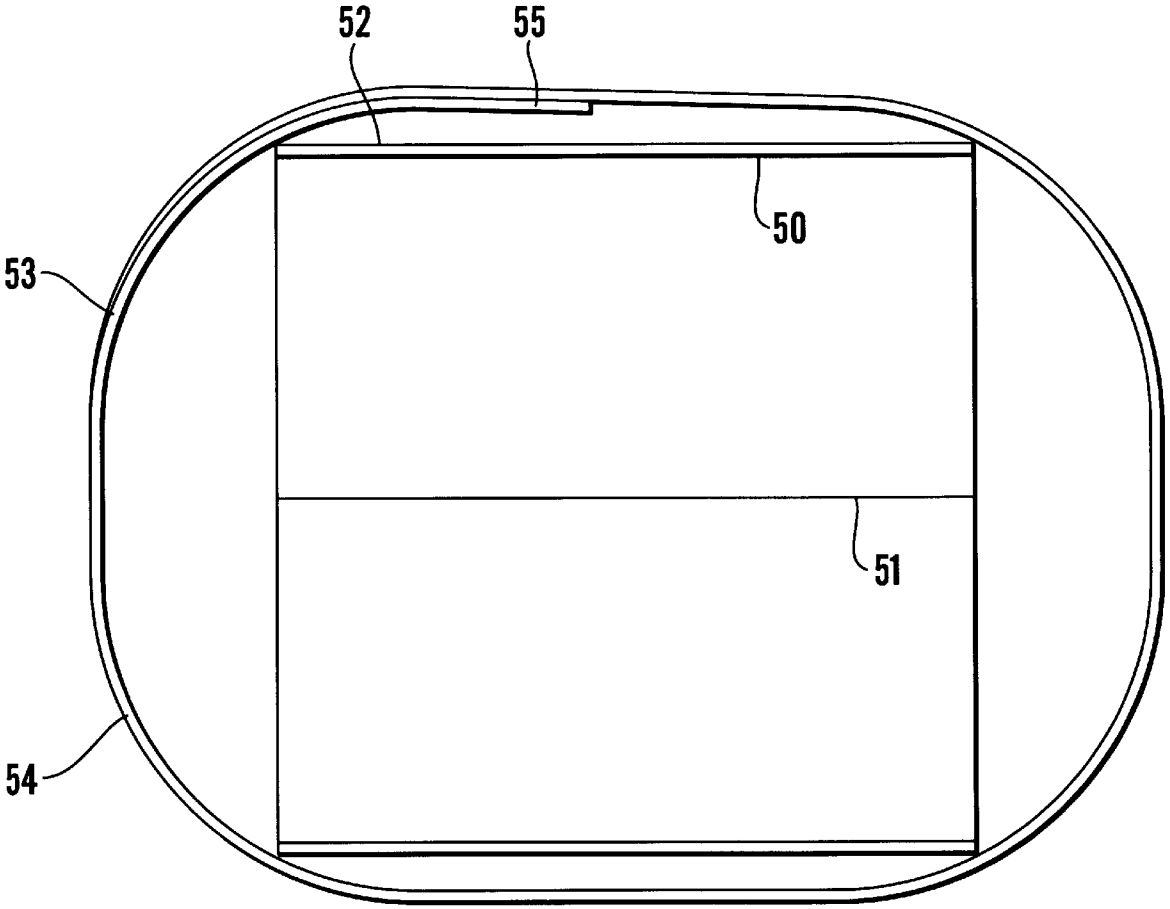
FIG. 6 is an end view, in simplified form, of yet a further typical example of a plurality of layers of flexible insulating material for use in a transport container.
Figure 7:
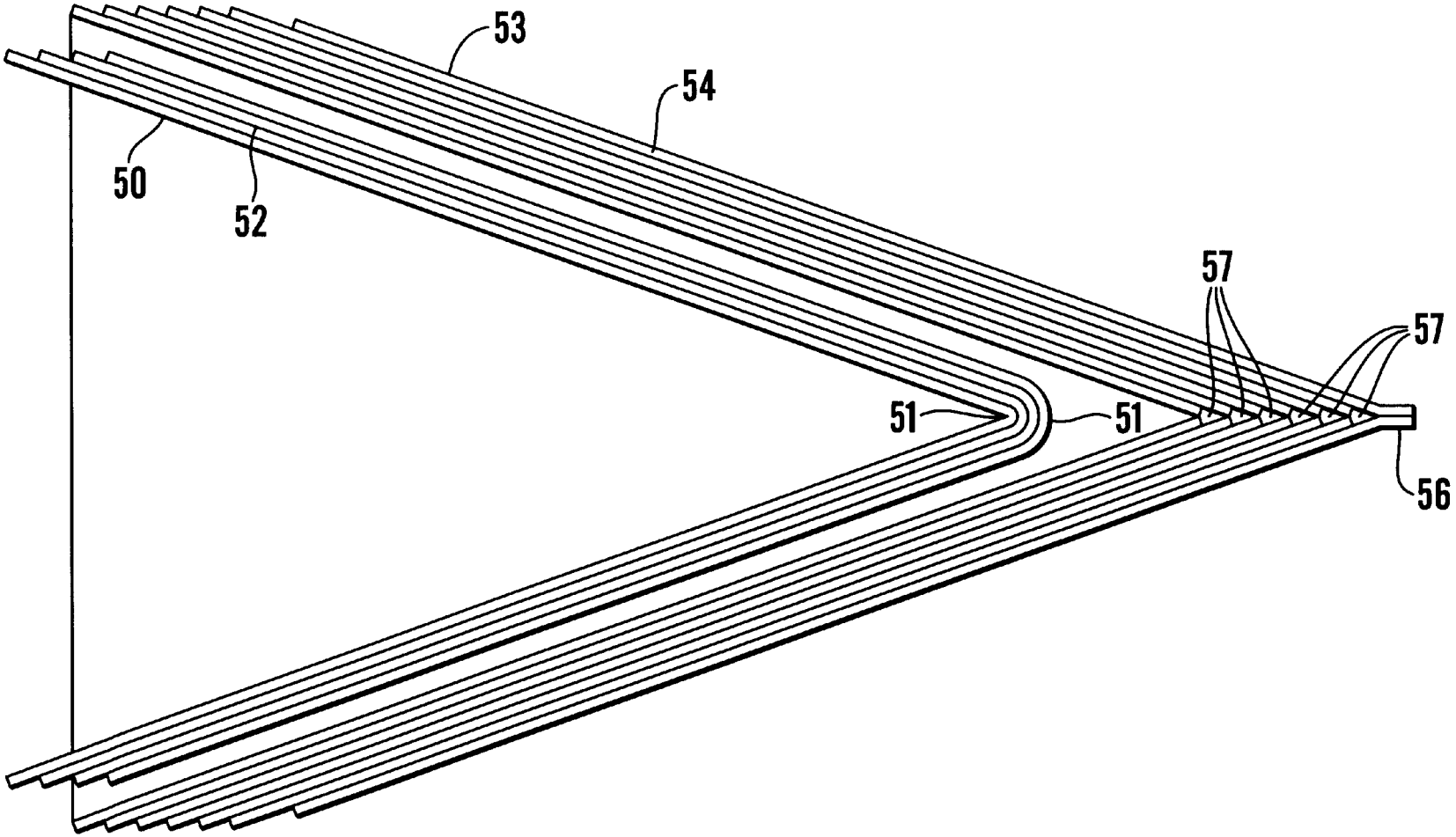
FIG. 7 is a cross-section view taken along the line 7—7 on FIG. 6, and FIGS. 8 and 9 are views similar to FIGS. 5 and 7 respectively showing the use in the latent cavities of shells of a plurality of layers of flexible insulating material.

Referring now to FIGS. 6 and 7, in the further typical example, there is an inner set 50 of layers each consisting of a sheet 52 of flexible insulating material in the form of a polyethylene foam sheet. Each sheet 52 is folded in half in a U-shape with a base 51 and nested in the other sheets 52. FIG. 6 only shows a single sheet 52 for simplicity, but FIG. 7 shows four sheets 52 clearly nested together.

There is also provided an outer set 53 of layers 54 of flexible insulating material which result from a single sheet 55 being wound several times around the outside of the inner set 50 of layers 51 and closing the otherwise open sides of the inner set 50 of layers. FIG. 6 only shows a single overlapped winding for simplicity, but FIG. 7 shows seven layers 54 resulting from seven windings. FIG. 7 also shows that as the sheet 55 is wound into position, it is laterally progressed away from the inner set 50 of layers 51 to enable the outermost winding to be in contact with itself along a bottom edge 56. This edge 56 is then bonded together by the use of adhesive or double-sided adhesive tape or heat-sealed by a hot air jet at a greater temperature than 120 degrees Celsius. If required, the edges 57 alongside the bottom edge 56 can all be sealed together.

In FIG. 7, the sets 50 and 53 of layers are shown slightly spaced apart, but in use these sets are jammed tightly together, and all of the layers are kept squeezed together by the heat-shrunk envelope 2 as described above.

Figure 8:
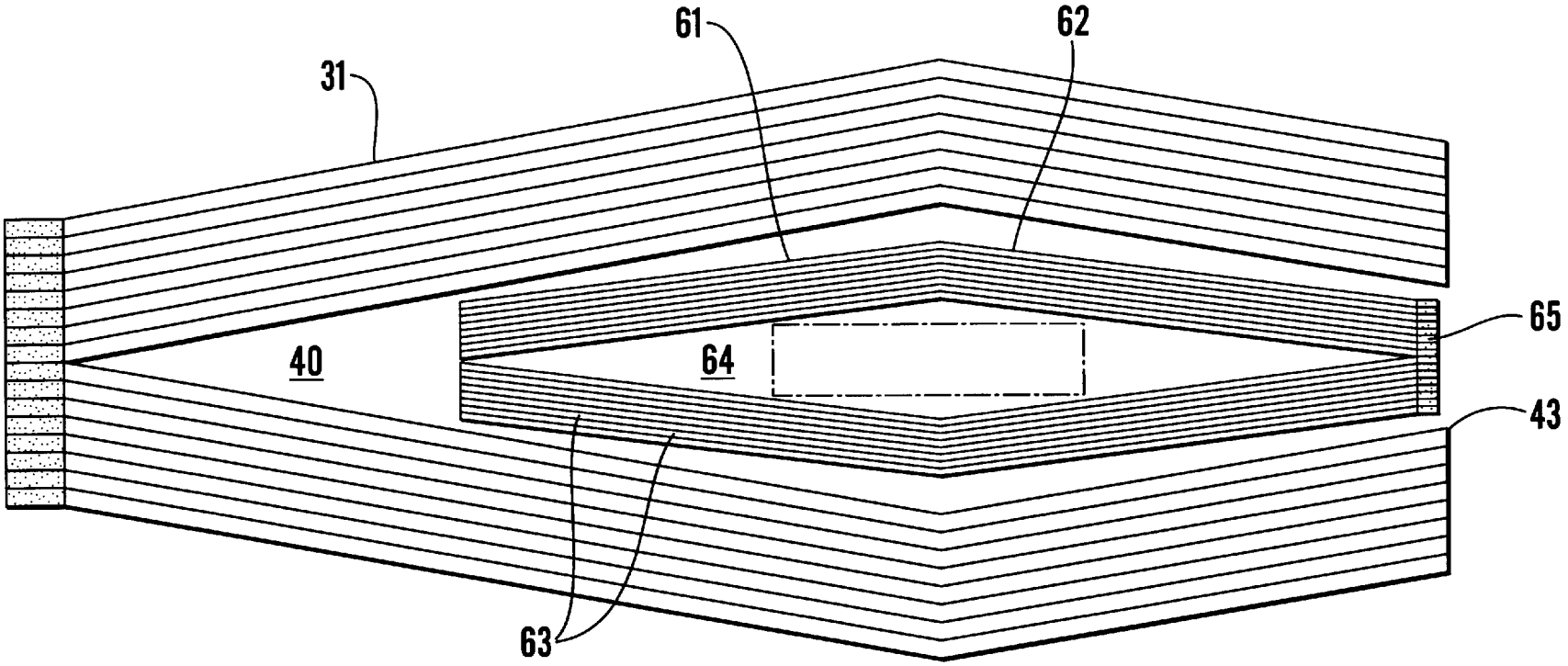

Referring now to FIG. 8, this shows the multi-layered roll 31 of FIG. 5 with its latent cavity 40 into the open end 43 of which has been telescoped a further multi-layered roll 61 of the same design as the roll 31 but on a smaller scale of about two thirds its length.

The multi-layered roll 61 constitutes a shell 62 of a plurality of layers 63 of flexible insulating material and including a shell latent cavity 64 within its plurality of layers 63 of flexible insulating material.

The shell 62 can be used in various ways, as follows. Firstly, a cold chain product to be transported can be inserted in the shell latent cavity 64 with its dry ice refrigerant; the shell 62 in combination with the multi-layered roll 31 provides excellent insulation, and a long transport time before the dry ice refrigerant has sublimed away. Secondly, a cold chain product to be transported in the temperature range of from 0 to 8 degrees Celsius can be inserted in the latent cavity 40, followed by the shell 62 containing dry ice in the shell latent cavity 64; the insulation of the shell 62 between the cool product and the dry ice prevents the cool product from falling below its minimum temperature, but the dry ice keeps the cool product below its maximum temperature of, for example, 8 degrees Celsius for a long time. Thirdly, a warm product can be inserted in the latent cavity 40 followed by the shell 62 containing a warmed icemat, the insulation of the shell 62 between the warm product and the warmed icemat prevents the product from heating too much.

The bonded join 65 of the shell 62 is aligned with the opening 45 of the multi-layered roll 31 to aid the closure of the latent cavity 40.

Figure 9:
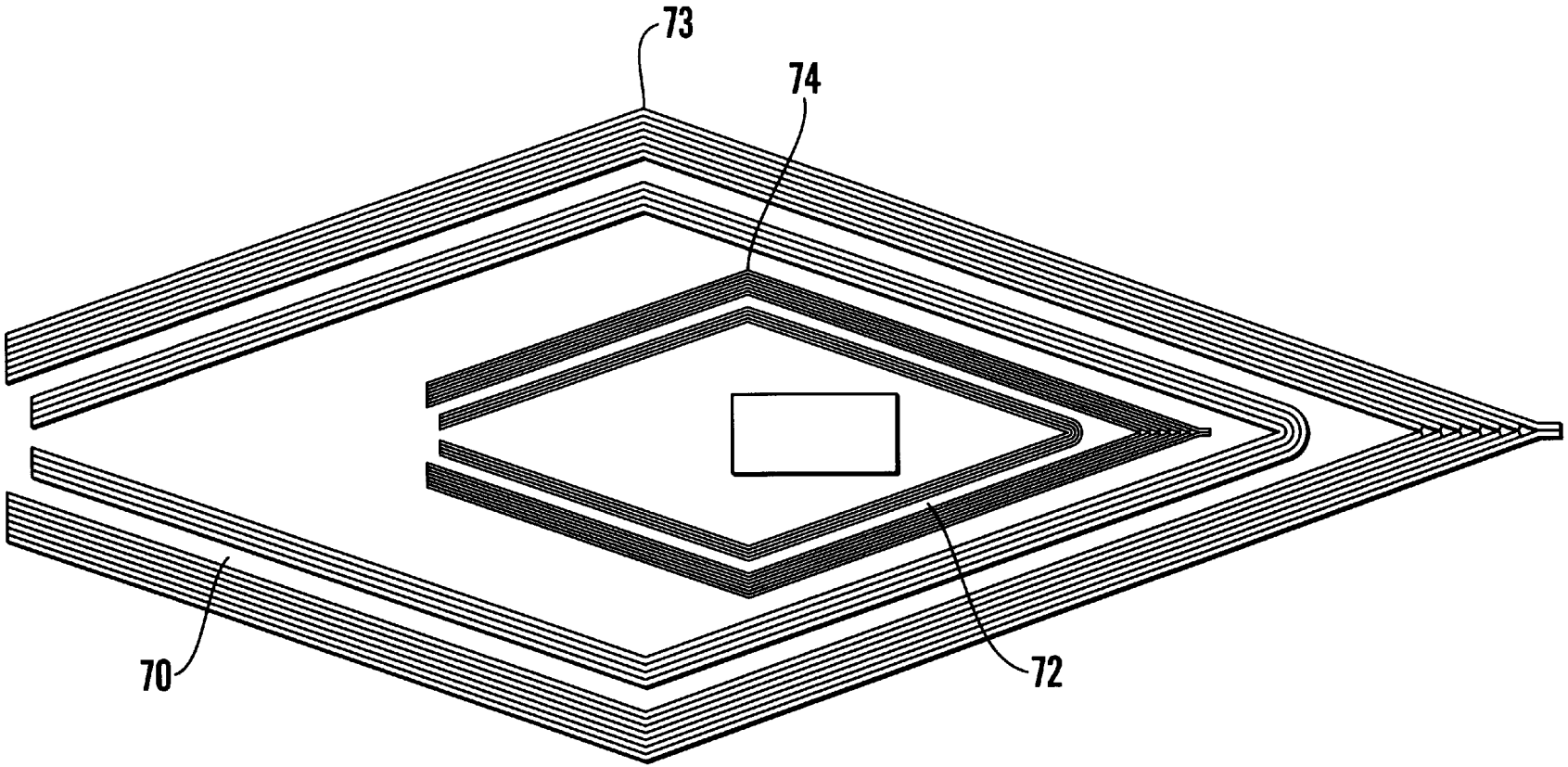

Referring now to FIG. 9, this shows the further typical example described above in relation to FIGS. 6 and 7, now denoted as 70, into the latent cavity 71 of which has been inserted a shell 72 of the same design as that further typical example 70, but of approximately half-size. The number of layers of flexible insulating material in the example 70 and the shell 72 may also vary according to the performance characteristics that are designed into the whole transport container. Said example 70 and shell 72 are shown in FIG. 9 with a crease 73,74 midway between the open and closed ends, but this is only for illustrative clarity because, in use, all of the layers of flexible insulating material are jammed tightly together, and are kept squeezed together by the heat-shrunk envelope 2 as described above.

The shell 72 is used in a similar way to the use of the shell 62 described above in relation to FIG. 8, except that it does not contribute to the closure of the example 70, being wholly contained within the latent cavity 71. A cold chain product can be placed with dry ice refrigerant in the shell 72, possibly with more dry ice alongside the shell in the latent cavity 71. A cold chain product for transport at 0 to 8 degrees Celsius can be placed beside the shell 72 in the latent cavity 71 with dry ice refrigerant in the shell 72. A warm product can be placed either in the shell with no other contents in the latent cavity 71, or be placed in the latent cavity 71 alongside the shell 72, the latter containing a warmed ice-mat.

The shell 72 is preferably sealed after receiving its contents, particularly to facilitate handling before the filled shell is inserted in the latent cavity 71. The example 70 is sealed after receiving all of its contents. Sealing of the shell 72 and the example 70 can be achieved by any of the methods mentioned above, especially by hot-air jet.

What is claimed is:

1. A transport container comprising a plurality of layers of flexible insulating material, an envelope containing said layers and shrunk against said layers, and a latent cavity within the layers of flexible insulating material and openable to receive a product to be transported in the transport container.

2. A transport container according to claim 1 wherein the envelope is heat shrunk against said layers.

3. A transport container according to claim 1 wherein the envelope is made of polyethylene.

4. A transport container according to claim 1 wherein at least one of the layers of flexible insulating material also has energy absorbing properties to protect the product against damage in transit.

5. A transport container according to claim 4 wherein at least the majority of the layers of flexible insulating material are foamed polyethylene.

6. A transport container according to claim 1 wherein the envelope is heat-bonded in position.

7. A transport container according to claim 1 for use in transporting a cold chain product wherein the latent cavity contains a refrigerant and the cold chain product.

8. A transport container according to claim 1 wherein said plurality of layers comprises a single sheet of flexible insulating material would several times around itself to define the latent cavity within the layers of flexible insulating material, and one edge of the wound sheet being flattened with all of the layers bonded together at that edge to provide a closed base for the latent cavity.

9. A transport container according to claim 8 wherein the other edge of the wound sheet is only partially flattened as a result of said one edge having been flattened, and all of the layers are bonded together at said other edge with the latent cavity openable to receive a product to be transported in the transport container.

10. A transport container according to claim 1 wherein said plurality of layers comprises an inner set of layers each consisting of a sheet of flexible insulating material folded into a U-shape and nested into the other folded sheets, and an outer set of layers resulting from a single sheet of flexible insulating material wound several times around the outside of the inner set of layers and closing the otherwise open sides of the inner set of layers.

11. A transport container according to claim 1 further comprising a shell comprising a plurality of layers of flexible insulating material, said shell being receivable within the latent cavity and including a shell latent cavity within its plurality of layers of flexible insulating material and openable to receive a product to be transported in the transport container and/or a refrigerant if the product is a cold chain product.

12. A method of assembling a transport container comprising taking a shrinkable envelope, inserting in the envelope a plurality of layers of flexible insulating material, providing a latent cavity within the layers of flexible insulating material and openable to receive a product to be transported in the transport container, and shrinking the envelope.

13. A method according to claim 12 including opening the latent cavity by inserting the product into it.

14. A method of assembling a transport container for use in transporting a cold chain product according to claim 12 including opening the latent cavity by inserting into it both a refrigerant and the cold chain product.

15. A method according to claim 12 including shrinking the envelope by heat-shrinking.

16. A method according to claim 15 wherein the envelope is heat-bonded in position.

* * * * *